United States Patent [19]

Neidecker et al.

[11] 4,332,434

[45] Jun. 1, 1982

[54] ELECTRIC TERMINAL AND ASSEMBLY CONTAINING SAME

[75] Inventors: Rudolf Neidecker, Basel, Switzerland; Bernd Rüsing, Heiligenhaus, Fed. Rep. of Germany

[73] Assignee: Multi-Contact AG, Allschwil, Switzerland

[21] Appl. No.: 110,602

[22] Filed: Jan. 9, 1980

[30] Foreign Application Priority Data

Jan. 13, 1979 [DE] Fed. Rep. of Germany ..... 2901201

[51] Int. Cl.[3] ..... H01R 9/12

[52] U.S. Cl. ..... 339/258 R; 339/262 R; 339/255 B

[58] Field of Search ..... 339/17 C, 18 R, 95 D, 339/254, 255 B, 258 R, 258 P, 262 R, 273 S, 275 R, 275 B, 275 T; 434/301

[56] References Cited

U.S. PATENT DOCUMENTS

| | | | |
|---|---|---|---|
| 2,983,892 | 5/1961 | Williams et al. | 434/301 |
| 2,983,894 | 5/1961 | Lawson et al. | 339/95 D |
| 3,343,121 | 9/1967 | Lewis | 339/95 D |
| 3,368,188 | 2/1968 | Olsson | 339/275 R |
| 4,120,557 | 10/1978 | Horrocks | 339/258 R |

FOREIGN PATENT DOCUMENTS

| | | | |
|---|---|---|---|
| 470778 | 5/1969 | Switzerland | 339/95 D |
| 239632 | 9/1925 | United Kingdom | 339/262 R |

*Primary Examiner*—Joseph H. McGlynn
*Attorney, Agent, or Firm*—Karl F. Ross

[57] ABSTRACT

An electric terminal, especially for a circuit board, e.g. of the breadboarding type for use in experimental circuit design, is formed with an annular groove with inner and outer walls and an annular spring element braced against one of these walls and engageable with a conductor inserted into the groove to mechanically retain the same and, at the same time, form an electrical connection therewith and with other conductors inserted into the groove. Preferably an array of such terminals is provided in respective recesses of an electrically insulating board.

8 Claims, 9 Drawing Figures

FIG.7
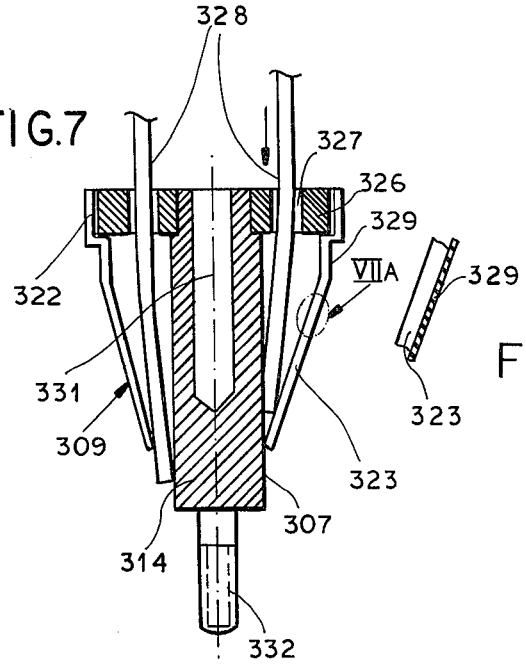
FIG.7A
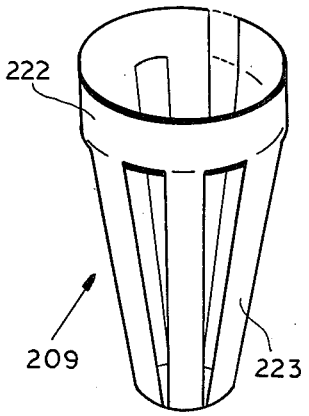
FIG.6
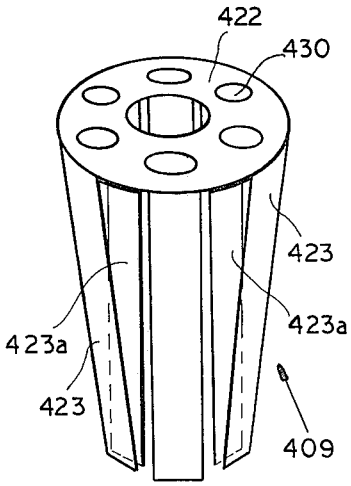
FIG.8

ELECTRIC TERMINAL AND ASSEMBLY CONTAINING SAME

FIELD OF THE INVENTION

The present invention relates to an electric terminal and, more particularly, to an electric terminal suitable for use in breadboarding and, in general, the assembly of electronic circuits from circuit components or integrated circuit units and the like.

BACKGROUND OF THE INVENTION

Electrical connectors using spring action are known from, for example, U.S. Pat Nos. 3,453,587, 3,845,451, 3,828,301, 3,895,853 and 4,083,622 which are commonly assigned herewith and in which one of the present inventors is also named as an inventor.

These systems are used primarily for forming an electrical connection between two elements one of which can be a plug engaging the spring-like lamellae of such connectors.

Electrical terminals are known in a variety of configurations and for a variety of purposes and mention can be made of several for background purposes. For example, terminals may be used in so-called mosaic circuit configurations in which a number of components are removably interconnected by being plugged in or otherwise tied to terminals maintaining a connection between the components. In addition, such terminals may be used to tie a number of components or conductors to another conductor or component, in miniature electronic circuitry and in macrocircuitry for a variety of connecting purposes.

In general, a terminal can make an electrical connection between one conductor and another conductor and can have a plurality of contact pins, wires or the like which form the connection. The terminal can be of the screw type, can be of the spring or plug type, or can be of the twist type, depending on how the conductor or group of conductors is or are anchored to the terminal.

For breadboarding purposes, in the establishment of circuit designs or for the fabrication of prototype or other circuits, it is known to provide an insulating board with a multiplicity of such terminals, usually in a regular array, to which various electronic components can be connected, to which conductors such as jumpers between components may be connected, and to which printed circuit conductors may be electrically connected as required.

While the present invention will be described primarily in connection with such experimental tables or boards, more generally breadboards, it should be noted that the principles of the present invention are more generally applicable to any type of circuit arrangement in which a terminal for a plurality of conductors must be provided.

Referring again to experimental boards and particularly breadboards provided with a multiplicity of terminals in a regular array, mention may be made of the fact that each such terminal may be used to connect one or more pins, bars, tabs, tongues or other connective elements of an electrical component such as a resistor, condenser, diode or transistor, to a conductor, such as a jumper wire. The terminals are also used to mechanically anchor and/or electrically connect encapsulated circuit elements and the array of terminals should be designed such that the connecting relationship of the various components can be readily ascertained and understood so that the system may be used for educational and evaluation purposes as well as circuit design. The components which are interconnected by such terminals can be complete circuits capable of performing particular functions and provided with a limited number of conductors for, for example, connecting the circuit unit to a source of power and to input and output signal processing units. These circuit elements can be mechanically and electrically fitted into the terminals of the experimental table or plate and any breadboard carrying the terminals. The assembly may thus be suitable for the mechanical mounting and electrical connection of the circuit elements, for display of the circuit organization and the like.

Conventional electrical terminals for the aforementioned purposes consist of more or less complicated contact springs which generally are mounted between an upper plate and a lower plate of an experimental table and to which access is afforded by bores provided in the upper plate and serving to permit the contact pins, wires or conductor elements generally of the electronic components or units to engage the contact springs. The units are then electrically interconnected by these contact springs to one another.

The terminals are distributed more or less uniformly on the base or board formed from the upper and lower plates. The connecting bores associated with each contact spring are themselves generally regularly spaced and distributed. For example it is known to provide a cruciform arrangement of contact bores, e.g. at the corners of a rhombus, for each contact spring or to arrange the contact bores along a line, the contact spring being similarly cruciform in configuration or of linear configuration.

The conventional terminals have various disadvantages. For example, it is disadvantageous to require a respective connecting bore in the upper plate for each wire to be tied to a respective terminal and to arrange such bores in a perfectly regular configuration. Because of this characteristic of prior-art systems, the terminals of earlier systems have been able to accommodate only a reduced number of (generally up to four) components. Attempts to increase the number of interconnecting a plurality of terminals result in removing a number of intrinsically individual terminals and in making the circuit unsightly or incapable of satisfactory monitoring.

A further disadvantage, especially when the system is to be used for didactic purposes, is that a center of connection is not readily ascertainable for each terminal or group of connecting bores. The junctions appear to be diffuse and it is difficult to ascertain how a circuit can be improved using a conventional system with a distributed array of bores each for a single connector and all cooperating with a single terminal.

In addition, the conventional systems have been found to be relatively complicated to fabricate, to be expensive, and to require contacts or terminals of relatively complicated configuration.

OBJECTS OF THE INVENTION

It is the principal object of the present invention to provide an improved terminal, particularly for use in experimental circuit boards and tables, which avoids the disadvantages of the earlier systems and can be fabricated in a simple and economical manner.

Another object of the invention is to provide a terminal assembly which can be used for experimental circuit design and display or teaching, whereby the disadvantages of the earlier systems are obviated and a more readily ascertainable relationship between interconnected components can be afforded.

Still another object of the invention is to provide an improved terminal in which a relatively large number of conductors can be mechanically anchored and electrically interconnected.

Yet a further object of the invention is to simplify experimental and like circuitry using terminals for a multiplicity of components.

It is still another object of the invention to provide an electric circuit assembly which permits improved monitoring of the relationship of the interconnected circuit elements at lower cost than has been possible heretofore, particularly when a large number of connection possibilities is to be ensured.

SUMMARY OF THE INVENTION

These objects and others which will become apparent hereinafter are attained, in accordance with the present invention, in a system which comprises a support formed with a terminal constituted with an annular groove having inner and outer walls between which a conductive element, such as a component pin or conductor end can be received, and at least one annular spring element receivable in the groove and braced against one of these walls for mechanically engaging and forming an electrical connection with such a conductor end or pin.

The configuration of the terminal in accordance with the present invention allows the connection of connecting pins, wires or the like or integrated or like circuit units as well as individual circuit components in a large variety and number without having to insert each of the conductor elements into a respective discrete terminal bore. The reason for this is, of course, that the conductor elements are introduced into an open annular bore in any number and size relationship as may be accommodated in this bore. The number of conductor ends is thus limited only by the dimensions of the annular groove or the conductor pins, wires or the like and in practice a relatively large number of connecting pins, wires or the like conductor elements can be inserted into a given terminal.

The annular groove of the terminal according to the present invention can have any desired plan configuration although, as a rule, it will be of circular configuration. In any case, the annular groove defines, inwardly of the inner wall, a so-called "core" having a well-defined and readily recognizable center so that the terminal itself can be easily identified and the junction formed thereby for a plurality of circuit elements can be readily visible and ascertained.

A plate provided with a plurality of such terminals, usually a multiplicity thereof in a regular array, need no longer be constituted of upper and lower plates as has hitherto been the case, since each terminal can fit in a single bore or recess in the single plate or base constituting the experimental table or breadboard of the present invention.

The terminals can be molded in place in such a board or can be inserted into bores of the board after the drilling thereof with a friction or mating fit.

The fabrication of the terminal elements of the present invention or assemblies thereof, e.g. experimental tables or breadboards with such elements, has been found to be extraordinarily inexpensive.

The electrical connection between the conductor elements (i.e. the pins, wires or the like) can be effected by a conductive inner wall or a conductive outer wall or both conductive inner and outer walls. Preferably, however, the electrical connection is effected at least in part by the use of a conductive spring element which mechanically grips the conductor element in the manner described. In other words, it has been found to be advantageous to form the conductive element of the terminal as the annular or ring-shaped spring element.

The advantage of using a conductive spring element as the sole conductor of the terminal in that either or both of the walls can be of electrically insulating material in which case a terminal whose inner and outer walls are formed by a sleeve and core, respectively, of electrically insulating material can be inserted into a conductive base plate. The outer wall may, moreover, be formed of the insulating material of the base plate when the latter is nonconductive.

Throughout this description, nonconductive elements of the terminal or base plate may be constituted or synthetic-resin material, synthetic-resin bonded fiber, hard rubber or like materials commonly used in the fabrication of experimental plates or circuit boards.

The spring element of the invention is, most advantageously, composed of a metal alloy having good electrical conductivity and high elasticity, for example, (preferably hardened) beryllium-copper or beryllium-bronze alloys.

The configurations of the spring element can be selected from a variety of forms. For example, the spring element can have the configuration of a barrel-shaped ring which is produced by stamping, punching or upsetting and can have slits parallel to the axis of the ring defining ribs which engage the conductor elements and the wall against which the ring bears.

An especially advantageous configuration of the terminal makes use of a spring element which can be formed from a lamellar strip of the type described in the aforementioned patent in which contact lamellae are bent out of the plane of the slitted strip, the strip in turn being bent into an annular configuration.

The contact lamellae thus run substantially parallel to the longitudinal axis of the annular groove into which the bent strip is fitted and are bent about their respective longitudinal axes out of the plane of the strip to form free shape contact edges.

Such contact arrangements are also to be found in German patent documents (printed applications—Auslegeschriften) Nos. 12 86 170 and 22 43 034. These contact springs have, however, hitherto found application only as contact elements in jacks, plugs and the like.

The use of such contact rings in accordance with the present invention has a significant advantage because the engagement of the conductor elements by the contact edges affords an electrical connection with minimum contact resistance and high reliability. In addition, the contact lamellae bring about an advantageous orientation of the conductor elements (pins, wire ends or the like) and permit, depending upon the need and desire, the engagement between the conductor element between the ring and the inner wall and between the outer wall or only between the ring and one of these walls.

As previously indicated, the annular groove can be formed in different ways. For example, the outer wall can be formed by a cup-shaped element while the inner wall can be formed by a core of material formed from the cup and unitary therewith. The core-forming post can be molded together with the cup-shaped structure and can be of electrically conductive material therewith. Of course, the post can also be formed separately from the cup-shaped member and can be fitted therein, e.g. by molding, upsetting or the like. The post may be composed of electrically conductive material.

When the assembly is constituted as an experimental table or plate, the terminal can be formed as a unit with a comparatively massive terminal body formed with the annular groove and composed of metal or synthetic-resin which is inserted in a corresponding opening of the base plate of the experimental table or can be molded therein. It is also possible, in accordance with the present invention, to use as the outer wall of the annular groove, the walls of a recess in the base plate. In this case the core or post can be set into the base plate itself and can be held therein in a form-fitting relationship, by, for example, a bulge or other formation or by the upsetting as in the case of a rivet, especially a blind rivet, or can be embedded in the material of the base plate during the molding thereof (usually by injection molding).

It is also possible, in accordance with the present invention, to fabricate experimental tables with the annular groove unitarily, e.g. by injection molding, with the spring element being thereupon inserted.

It has been found to be desirable to anchor the annular spring element in the annular groove. This can be achieved, in accordance with one feature of the invention, by providing the spring element with a peripheral tension as a result of elastic deformation so that the intrinsic elasticity of the spring element serves to anchor it in place. The resulting force fit is sufficient in many cases.

The elastic formation of the spring element to provide the peripheral stress can be achieved in a particularly effective and reproducible manner when the spring element is constituted from the lamella strip of the aforedescribed type and the contact lamella is gathered perpendicular to the axis of the contact lamella (see German patent document 22 43 034).

It is also possible to provide a form-fit between the spring element and the annular groove in any one of a number of ways. For example, the post can be provided with a collar which, upon insertion of the post can retain the spring element. This has been found to be an advantageous construction when the annular groove is produced by insertion of a post.

It is also possible to provide the inner and/or outer walls of the annular groove with recesses or cutouts in which the spring element can be snapped or beneath which the spring element can engage. This facilitates the insertion of the spring element and its retention in place.

In a third construction which has been found to be especially effective for use with experimental tables with a base plate, the inner and/or outer walls of the annular groove are formed from a thermoplastic material and the spring element is introduced into the annular groove with elastic peripheral stress whereupon the thermoplastic material is heated to the softening point and form-fittingly is pressed into engagement with the ring element. The heating of the thermoplastic synthetic-resin can be effected in a particularly simple and precisely controllable fashion by the use of high-frequency heating. The spring element can be pressed into a soft synthetic-resin material, e.g. by relaxation of the prestress applied to the spring element or the synthetic-resin material can be pressed onto the spring element.

When elastic prestress is mentioned herein it is preferably applied so that the peripheral tension is effective only at an end of the spring element, e.g. the upper end, or at both ends. Advantageously the spring element is barrel-shaped, conical or otherwise formed with a smaller diameter at one end than in a central portion of the spring element or at the opposite end thereof.

According to a further feature of the present invention the spring element of the terminal comprises a support ring and a multiplicity of spring tongues or fingers which extend from the support ring and are adapted to trap connecting pins, wires or the like, between each tongue and an inner or outer wall of the annular groove against which the tongue resiliently bears.

The spring element here cooperates with the inner or outer wall in a clamp-like manner so that the fingers not only provide the pressure for electrical contact, but also mechanically retain the connecting wires.

Since the spring pressure is applied against only one of the walls, i.e. the inner or outer wall, against which the spring element bears, the other wall may be free from pressure so that it can be constituted, for example, from an elastic material.

The spring element of the present invention can also be fabricated particularly conveniently when the inner or outer wall against which the spring tongues bear is also formed on the spring element itself.

Furthermore, the spring element can be braced only against the inner wall so that the outer wall is formed from the spring element. In this case it is necessary to provide between the support ring of the spring element and the inner wall of the annular groove on or more openings into which the connecting pins, wires or the like can be inserted.

Alternatively, the inner wall can be formed unitarily with the spring element in which case the outer wall has a cup configuration. In both cases the spring element can be inserted from the exterior and the wall forming part of the spring element can be coated with an insulating layer of a lacquer, synthetic resin, rubber or the like.

According to yet another feature of the invention both the inner and outer wall can be formed unitarily with the spring element, in which case a double-tongue arrangement can be provided with the tongues of each pair pressuring toward or pressed against one another and clamping the connecting pin or wire between them.

According to still another feature of the invention, a central connecting point is provided within the annular groove, e.g. in the form of a pin socket, jack or the like. This central connector can serve to supply the conductors anchored by the spring element from a central current source, can be used as a test point or the like.

The central connecting point can also be formed as a screw terminal, a solder junction or even as a wire-wrap post or as a Termi-point connector.

Of course, more than one connecting system can be provided for the central contact point, e.g. a core can be provided as a pin jack and also as a screw terminal.

When the inner wall of the annular groove is formed on the spring element as a metal body, the electrically conducting connection between the spring element and the contact point received in or formed by this wall is automatic, as is the case when the core is electrically conductive, forms the inner wall, and supports the insertable conductors against the pressing force of the spring tongues.

When the inner wall is formed of electrically insulating material, however, a special electrical connection must be provided with the spring element and, for this purpose, the connecting post or tongue can be provided with a special contact lug or finger.

The terminals of the present invention have been found to be especially advantageous because of their versatility and their ability to interconnect a comparatively large number of conductors (pins, wires or the like), so that the nature of the connection can be readily monitored and observed. The systems are of low cost and allow circuitry to be readily analyzed. Furthermore, they permit current supply to selected junction points or testing of selected junction points with ease.

Finally, the terminals of the invention can be used without having to fit the spring elements into other bodies, so that fabrication of boards or circuit units embodying the terminals is facilitated.

BRIEF DESCRIPTION OF THE DRAWING

The above and other objectives, features and advantages of the present invention will become more readily apparent from the following description, reference being made to the accompanying drawing in which:

FIG. 6 is a perspective view of the spring element of the terminal of FIG. 5;

FIG. 7 is an axial cross-sectional view through a further terminal representing a fourth embodiment of the invention;

FIG. 7A is a detail view of the region VIIA of FIG. 1; and

FIG. 8 is a perspective view of another terminal representing a fifth embodiment of the invention.

SPECIFIC DESCRIPTION

Figure 1:
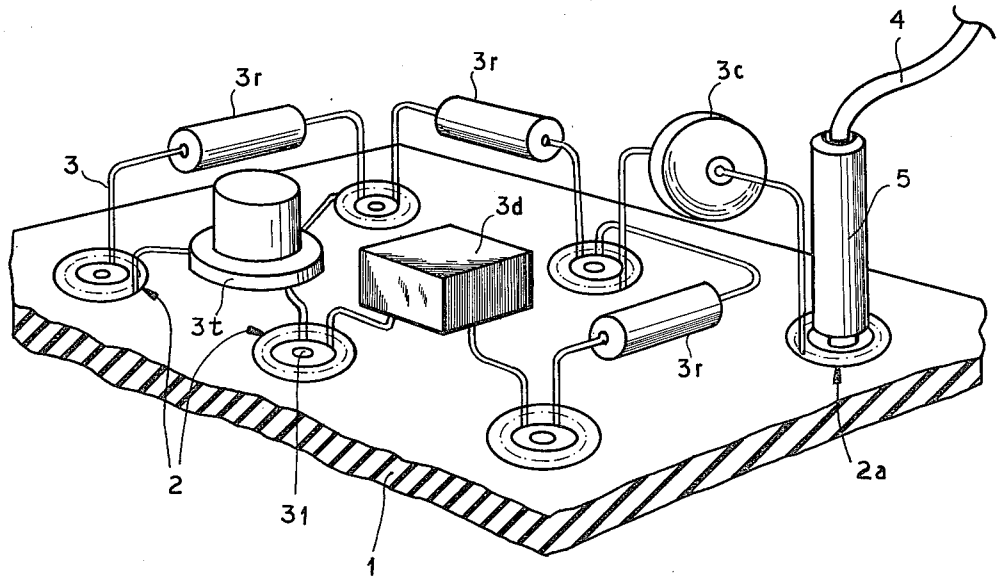
FIG. 1 is a fragmentary perspective view of a breadboard-type circuit embodying the principles of the present invention, with the terminals shown somewhat diagrammatically.

In FIG. 1 we have shown, greatly simplified, a breadboard circuit which comprises an electrically insulating plate 1 of thermosetting or thermoplastic synthetic resin which can previously be formed with a regular array of holes as is common in printed circuit board construction.

Each of the holes is provided with a terminal 2 which will be described further below, except to note that each terminal includes a central socket or connection point 31 into which a test probe or plug can be inserted for testing or current supply or output pickup, and an annular space into which conductors can be inserted for electrical interconnection.

For example, in the circuit shown in the drawing, a plug 5 forming part of a test circuit and provided with the test lead 4 is inserted into the terminal 2*a*.

The circuit elements can include resistors 3*r*, a capacitor 3*c*, a diode 3*d* and a transistor 3*t*. Two or more of the conductors or leads 3 of these circuit elements are inserted into the annular groove of respective terminals and thus are interconnected in a solderless manner. A banana plug similar to plug 5 may be used to supply current or tap and output as well as for test purposes.

Figure 2:
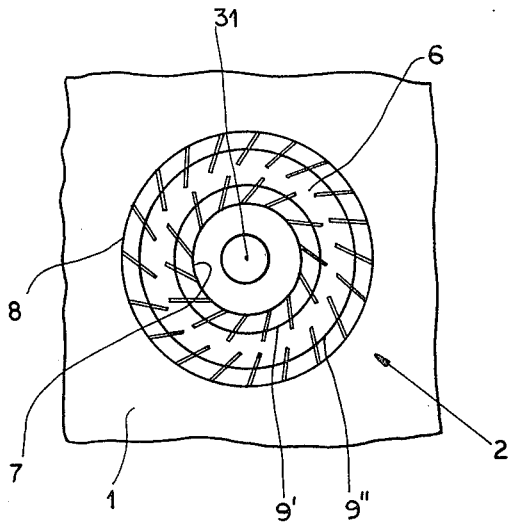
FIG. 2 is a plan view of a terminal according to the invention drawn to a scale greatly enlarged by comparison to FIG. 1.
Figure 3:
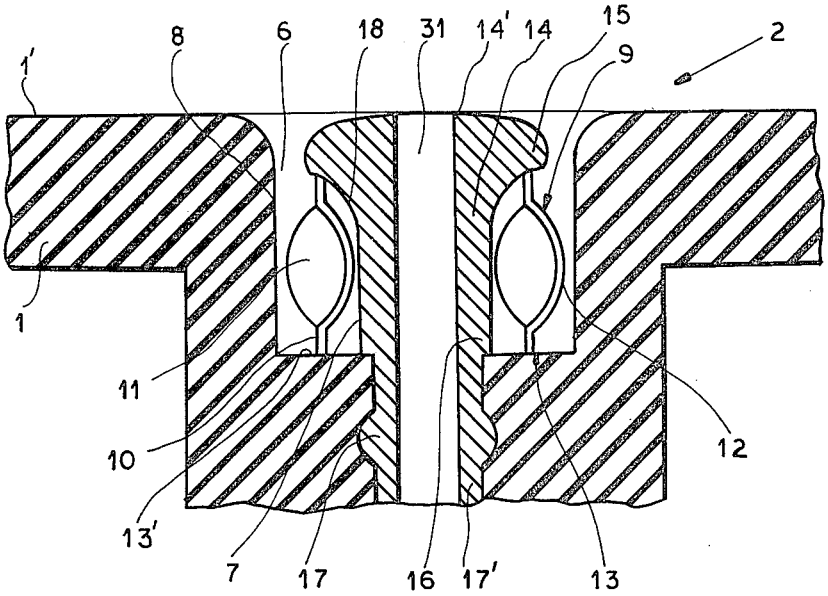
FIG. 3 is an axial section through the terminal of FIG. 2, showing a modification.

While FIG. 1 makes use of the terminal of FIGS. 2 and 3, it will be understood that the terminals of each of FIGS. 4, 5, 7 and 8 can be used in identical applications and breadboarding arrangements.

The terminal of FIGS. 2 and 3 has also been represented generally at 2 and can be seen to comprise an annular groove 6 defined between an inner wall 7 and an outer wall 8, a spring element 9 being received in this groove. From the drawing it will become apparent that the spring element 9 bears on the inner or outer wall 7 or 8 of the annular groove.

In the embodiment of FIG. 2 the spring element 9 consists of two coaxial rings, namely, an inner ring and an outer ring, represented at 9' and 9'', respectively. The spring means 9 of FIG. 3 consists of a single ring.

Upon the insertion of a connecting wire 3 (FIG. 1), an elastic deformation of the spring element 9 is effected, and the wire is mechanically energized and electrically contacted. To ensure electrical contact, the spring element 9, 9' or 9'' is composed of electrically conducting material and, as will be apparent, the wall of the terminal in FIG. 3 can also be composed of such material. When the wire is held against the outer wall, a sheath of this conducting material lining the outer wall can be provided. The conducting material can be beryllium-copper.

In the embodiment of FIGS. 2 and 3, the spring element is constituted as a lamella strip 10 with the individual contact lamellae being bent out of the plane of the strip. For details of this construction see U.S. Pat. No. 4,083,622 and the publications therein cited or mentioned.

The contact lamellae extend generally parallel to the longitudinal axis of the annular groove and are twisted about the respective axis to form sharp contact edges 12 which grip the conductors inserted into the annular groove.

In the embodiment of FIG. 3, moreover, the outer wall 8 of the groove 6 is cup-shaped and can be formed by a recess in the plate 1.

The jack 31 is formed in a post 14 whose upper surface 14' is flush with the upper face 1' of the board 1.

The electrically conductive post has an outwardly turned collar 15 which rests upon the upper edge of the spring element 9 to retain it against the floor 13' of the recess 13.

A form-fitting connection between the board 1 and the post 14 is provided by an outward bulge 17 on an extension 17' of the post which is seated in the board below the recess 13. A generally frustoconical outer surface 18 of the post, flaring to the collar, automatically centers the spring element 9 therearound.

Figure 4:
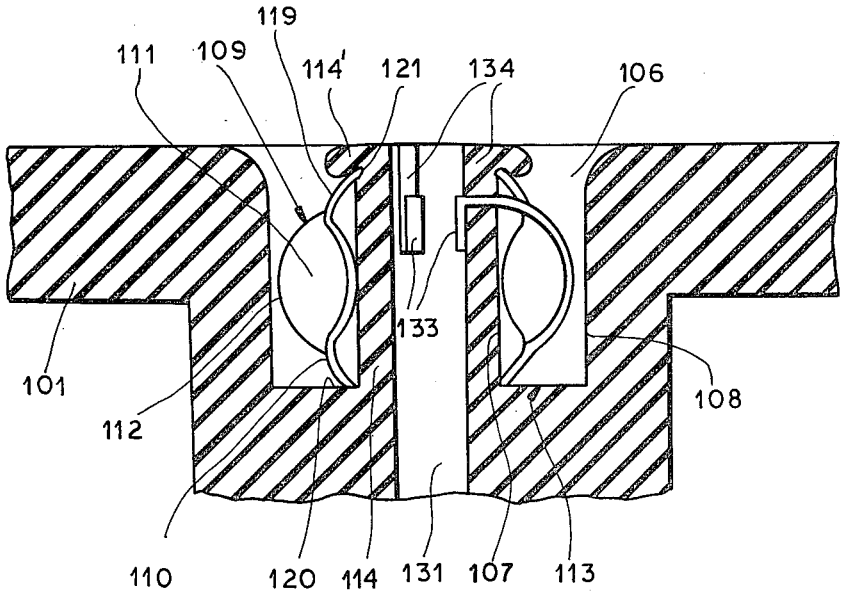
FIG. 4 is an axial cross-sectional view similar to FIG. 3 but illustrating another embodiment of the invention.

In the embodiment of FIG. 4, the board 101 is provided with recesses 113 which surround unitary posts 114 of electrical insulating material integral with the board 101. Thus both the inner wall 107 and the outer wall 108 of the annular groove 106 are electrically insulating and formed from the thermoplastic material of the board 101.

The spring element 109 is arched in axial cross section and engaged with its upper edge 119 in an undercut 121 of a head 114' produced by upsetting the post 114 after the spring element 109 has been inserted in the groove. The undercut has a smaller diameter than the diameter of the lower edge 120 of the spring element 109 whose twisted lamellae 111 correspond to the lamellae 11 mentioned previously and have edges 112. The strip from which the lamellae are twisted is represented at 110.

Because of this difference in diameters, a peripheral elastic stress is applied to the strip so that it has an undulating configuration which cannot be seen in the drawing and serves to maintain the stress on the spring element and increase the force with which a wire is gripped.

The upsetting of the head 114' can be effected by high-frequency heating and the application of pressure.

In this embodiment, unlike the arrangement of FIG. 3 in which the jack is formed by a bore 31 in the post, the bore 131 of the post 114 is electrically insulated and hence electrical connection to a plug or the like can only be effected through tongues 133 of the spring element bent over the inner wall of the bore 131 through slots 134 formed in the post 114.

FIGS. 5 through 8 show embodiments of the invention utilizing the same principle but wherein the resilient elements are not twisted lamellae, but rather are spring tongues or fingers whose free ends bear on the inner or outer wall.

Each of the spring elements 209, 309 and 409 of these embodiments thus includes a support ring 222, 322, 422 and a plurality of spring fingers 223, 323 and 423 which are unitary with the support ring and bear at the free outer ends against an inner or outer wall of a groove in the manner described.

Figure 5:
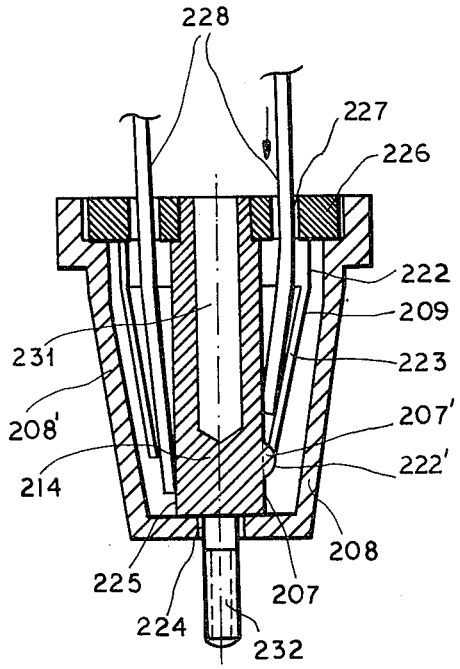
FIG. 5 is an axial cross-sectional view through the third embodiment of a terminal according to the invention.

Thus, in the embodiment of FIG. 5, the spring fingers 223 bear against an inner wall 207 formed by a central post 214, whose bore 231 forms a jack for a plug or the like and which is provided with a screw terminal 232 as well.

The conductors, here represented at 228, are inserted through bores 227 in a cover plate 226, to which the ring 222 can be soldered or otherwise anchored.

In this embodiment, moreover, the outer wall 208 is formed by a cup 208' having an opening 224 in its bottom through which the screw terminal 232 can be inserted, the shoulder 225 of the post 214 being of a larger diameter than the bore 224 so that it cannot pass through the opening. The conductors 228 thus are not only brought into electric contact with the post 214 by the pressure of the fingers, but can be mechanically engaged by the lower edges 222' thereof. The spring element is shown in greater detail in FIG. 6 and it can be noted that projections or the like can be provided as seen at 207', on the inner wall 207 to maintain an appropriate spacing or positioning of the tongue 223.

FIG. 7 shows an embodiment of the invention in which the outer wall of the annular groove is formed by the spring element itself. To insulate this outer wall or, more specifically, the spring tongues 223 against the surroundings, they are coated with an insulating lacquer 329. In this embodiment the support ring 322 can be bonded to the cover 326 whose bores 327 receive the conductors 328 which make electrical contact with the outer wall 307 of the post 314 which has a jack 331 and a screw terminal 332 in the manner previously described.

The embodiment shown in FIG. 8 uses a double tongue arrangement, i.e. outer tongues 423 and inner tongues **423*a* are paired and mounted upon the support ring 422 provided with bores 430** aligned with the pairs of tongues so that upon insertion of a conductor the same will be guided between the tongues which can bear upon one another and respectively form inner and outer walls of the groove.

We claim:

1. An electrical terminal for a multiplicity of conductors, especially for breadboarding and the like comprising means forming an annular groove adapted to accommodate a plurality of conductors and having an inner and outer wall, and including an annular spring member constituted of electrically conductive material and provided with a plurality of elements adapted to resiliently engage said conductors, said elements bearing on one of said walls, said outer wall generally being cup-shaped and said inner wall being formed as a post disposed centrally in the cup formed by the outer wall, said post being unitary with an insulating support forming said cup and being provided with a head having an undercut engaging an edge of said spring member.

2. The terminal defined in claim 1 wherein said spring member comprises a support ring and a plurality of spring fingers extending from said ring and forming said elements.

3. The terminal defined in claim 1 wherein said spring member is provided with pairs of spring fingers receiving a conductor between the fingers of each pair.

4. The terminal defined in claim 3, further comprising a disk-shaped cover plate provided with holes each adapted to receive a respective conductor and associated with a respective pair of fingers for guiding the conductor therebetween.

5. The terminal defined in claim 1 wherein said spring member is constituted of a lamellar strip with the individual lamellae bent out of the plane of said strip and forming said spring elements.

6. The terminal defined in claim 1 or claim 5 wherein said head is a portion of said post formed by upsetting and thermally softening a portion thereof.

7. The terminal defined in claim 1 or claim 5, further comprising means forming a central contact point within said spring member and electrically connected therewith.

8. The terminal defined in claim 7 wherein said means forming said central contact point includes a socket adapted to receive a plug, and a screw terminal on said socket.

* * * * *